United States Patent [19]

Sasaki

[11] Patent Number: 4,619,445

[45] Date of Patent: Oct. 28, 1986

[54] SPRING UNIT

[75] Inventor: Noboru Sasaki, Tokyo, Japan

[73] Assignee: France Bed Co., Ltd., Tokyo, Japan

[21] Appl. No.: 731,604

[22] Filed: May 7, 1985

Related U.S. Application Data

[63] Continuation of Ser. No. 493,330, May 10, 1983, abandoned.

[30] Foreign Application Priority Data

May 29, 1982 [JP] Japan ..... 57-92009
Feb. 22, 1983 [JP] Japan ..... 58-28230

[51] Int. Cl.[4] ..... F16F 3/04
[52] U.S. Cl. ..... 267/100; 5/256; 5/257; 5/260; 5/267; 5/272; 267/91; 267/103
[58] Field of Search ..... 267/91-106; 5/256, 257, 260, 261, 262, 267, 269, 271-277, 475

[56] References Cited

U.S. PATENT DOCUMENTS 3,286,281 11/1966 Slominski ..... 5/247
3,657,749 4/1972 Norman ..... 5/475 X
4,060,862 12/1977 Kitchen et al. ..... 5/260
4,371,152 2/1983 Kitchen et al. ..... 5/247 X

FOREIGN PATENT DOCUMENTS 1155218 10/1963 Fed. Rep. of Germany ..... 5/475
5668 of 1828 United Kingdom ..... 5/475
386251 1/1933 United Kingdom ..... 5/269

*Primary Examiner*—George E. A. Halvosa
*Attorney, Agent, or Firm*—Frishauf, Holtz, Goodman & Woodward

[57] ABSTRACT

A plurality of main springs and a plurality of intermediate support springs are disposed and fixed on a rectangular base plate. Each main spring has a linear connecting rod portion and two coil spring portions such that one end of each of the two coil spring portions is coupled to a corresponding one of two ends of the first linear connecting rod portion. The main springs are disposed such that these connecting rod portions are perpendicular to each other in a matrix form. The other end of each of the coil springs is fastened to the base plate. Each intermediate support spring has a connecting rod portion and two coil spring portions. The connecting rod portion of each intermediate support spring is shorter than that of each main spring. One end of each of the coil spring portions of the intermediate support spring is coupled to a corresponding one of two ends of the connecting rod portion of the intermediate support spring. The one end of each of the two coil spring portions is fixed to the connecting rod portion of the corresponding main spring. The other end of each of the two coil spring portions is fastened to the base plate.

5 Claims, 7 Drawing Figures

SPRING UNIT

This application is a continuation of application Ser. No. 493,330, filed May 10, 1983, and now abandoned.

BACKGROUND OF THE INVENTION

The present invention relates to a spring unit used for a mattress or a box spring.

A conventional spring unit used for a mattress or a box spring is known to have the following structure. Each of a plurality of main springs is made of a single wire. Each main spring has a straight rod portion and a pair of spring portions such that upper ends of the spring portions are coupled to two ends of the straight rod portion, respectively. The plurality of main springs are disposed on a rectangular base plate such that the straight rod portions thereof are at right angles to each other, forming a matrix. Lower ends of the spring portions are thus disposed around a periphery of the base plate and are fixed to the base plate. The straight rod portions of the main springs that are disposed in a matrix form are reinforced by intermediate support springs. Each intermediate support spring has a straight rod portion and a pair of spring portions in the same manner as the main spring. Upper ends of the spring portions are coupled to the straight rod portions of corresponding main springs, respectively, and lower ends thereof are fixed to the base plate.

In the conventional spring unit of this type, the spring portions of both the main springs and the intermediate support springs comprise torsion bar springs, respectively. A torsion bar spring deforms only slightly under a compressive load. However, when a compressive load is repeatedly applied to the torsion bar springs, a permanent set tends to occur. As a result, the conventional spring unit tends to lose its elasticity at a relatively early stage of use.

SUMMARY OF THE INVENTION

It is, therefore, an object of the present invention to provide a spring unit which retains a high elasticity over a long period of time.

In order to achieve the above object of the present invention, there is provided a spring unit comprising:

a rectangular base plate;

a plurality of main springs each having a first linear connecting rod portion and two first coil spring portions such that one end of each of said two first coil spring portions is coupled to a corresponding one of two ends of said first linear connecting rod portion, said plurality of main springs being disposed on said rectangular base plate such that said first linear connecting rod portions are at right angles to each other;

first fastening means for fastening the other end of each of said first coil spring portions to said rectangular base plate;

a rectangular frame;

first coupling means for coupling said rectangular frame to said one end of each of said first coil spring portions;

a plurality of intermediate support springs each having a second linear connecting rod portion and two second spring portions such that one end of each of said two second spring portions is coupled to a corresponding one of two ends of said second linear connecting rod portion, each of said second linear connecting rod portions being shorter than each of said first linear connecting rod portions, and said plurality of intermediate support springs being disposed on said rectangular base plate;

second coupling means for coupling one end of each of said second spring portions to corresponding ones of said first linear connecting rod portions; and second fastening means for coupling the other end of each of said second spring portions to said rectangular base plate.

BRIEF DESCRIPTION OF THE DRAWINGS

The accompanying drawings show an embodiment of the present invention, in which.

DETAILED DESCRIPTION OF THE PREFERRED EMBODIMENT

Figure 1:
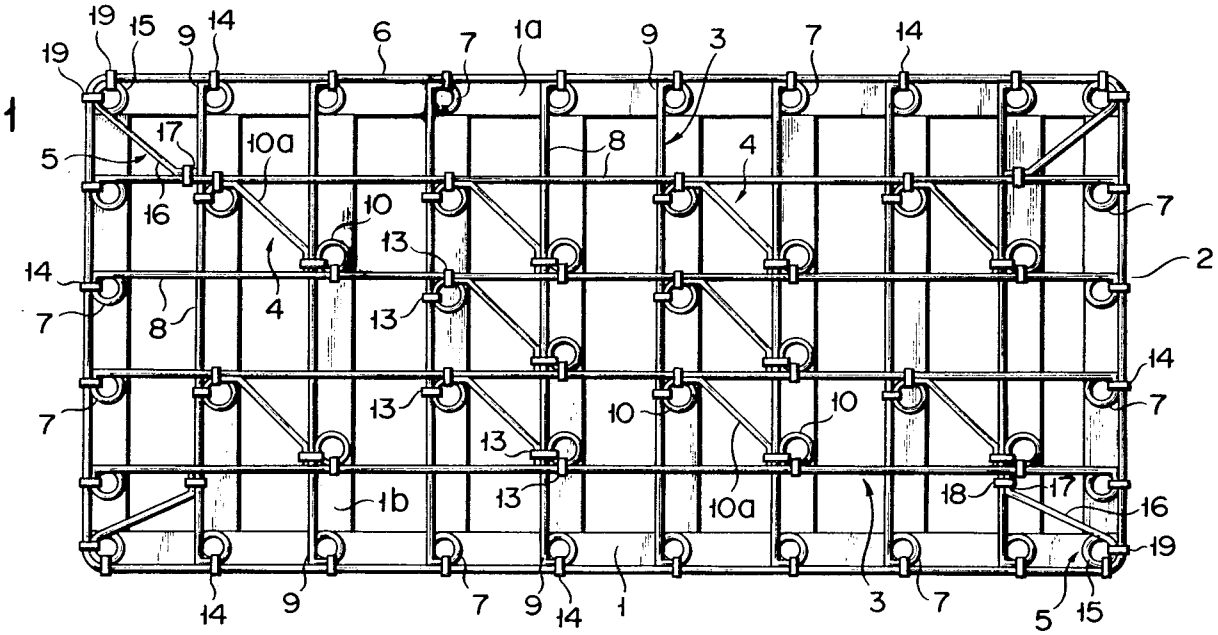
FIG. 1 is a plan view schematically showing the structure of a spring unit.
Figure 2:
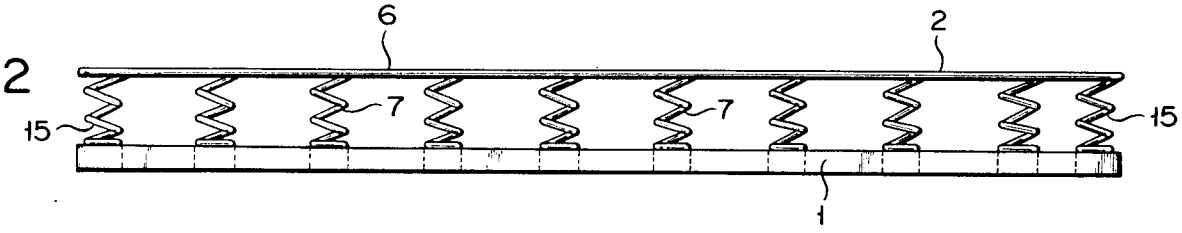
FIG. 2 is a side view showing the structure of the spring unit.
Figure 3:
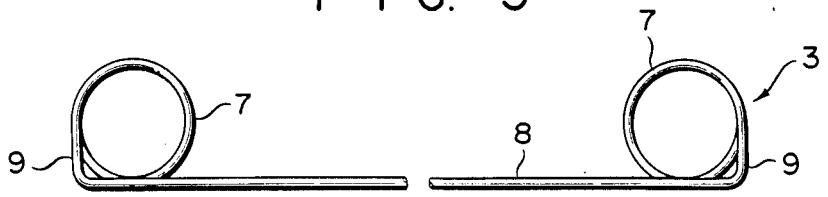
FIG. 3 is a plan view of a main spring.
Figure 4:
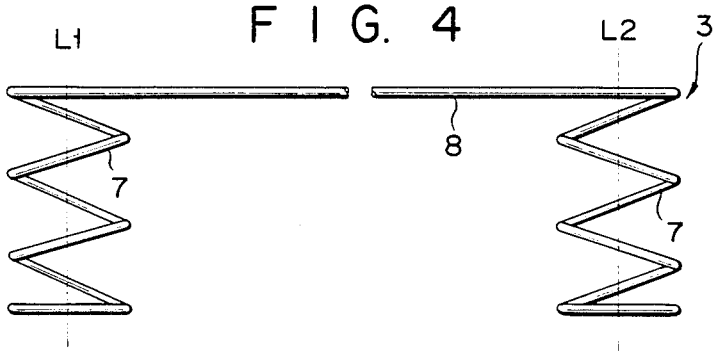
FIG. 4 is a side view of the main spring.
Figure 7:
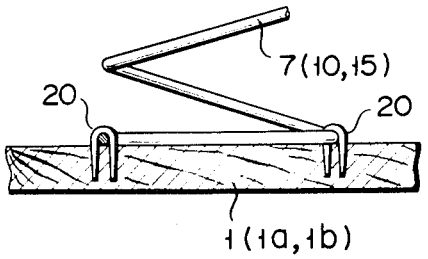
FIG. 7 is a side view showing a partial section of a coil spring and a base plate which are fixed to each other.

A spring unit according to an embodiment of the present invention, shown in FIGS. 1 and 2, has a base plate 1. The base plate 1 comprises a rectangular frame 1*a* and a plurality of crosspieces 1*b* arranged to be parallel to short sides of the frame 1*a* at equal intervals. A plurality of main springs 3, a plurality of intermediate support springs 4, a plurality of corner springs 5, and a frame 6 are disposed on the base plate 1 in a manner to be described later. Each main spring 3 has a linear connecting rod portion 8 and a pair of coil spring portions 7. One end of each coil spring portion 7 is connected to a corresponding one of two ends of the connecting rod portion 8. Each main spring 3 is made of a single steel wire having a circular sectional profile. Each pair of coil spring portions 7 has a structure shown in FIG. 4 in which axes L1 and L2 thereof are parallel to each other. Each of straight portions 9 is connected between an end of the connecting rod portion 8 and one end of a corresponding one of the pair of coil spring portions 7. The straight portions 9 are at right angles to the connecting rod portions 8. The plurality of main springs 3 are disposed on the base plate 1 such that the connecting rod portions 8 thereof are arranged at right angles to each other, forming a matrix. The coil spring portions 7 of each main spring 3 are disposed on the frame 1*a* of the base plate 1. One lower end of each coil spring portion 7 is fixed by a plurality of staples 20 to the frame 1*a*, as shown in FIG. 7. Note that each connecting rod portion 8 arranged parallel to the long side of the base plate 1 is longer than that arranged parallel to the short side thereof.

Figure 5:
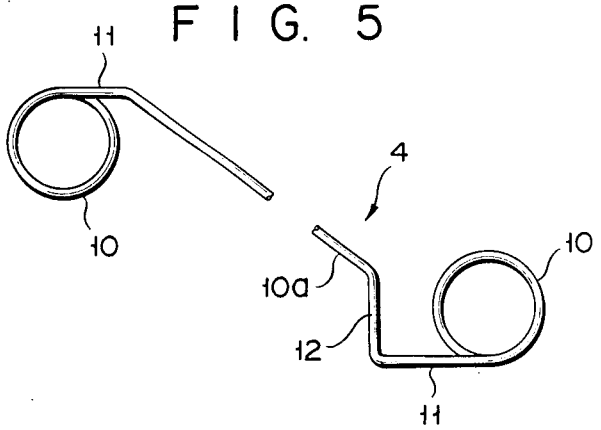
FIG. 5 is a plan view of an intermediate support spring.

Each intermediate support spring 4 has a linear connecting rod portion 10*a* and a pair of coil spring portions 10, in the same manner as each main spring 3. One end of each of the coil spring portions 10 is connected to a corresponding one of two ends of the connecting rod portion 10*a* through a straight portion 11 and a bent portion 12. Each intermediate support spring 4 is made of a single steel wire having a circular sectional profile. The connecting rod portion 10*a* of each intermediate support spring 4 is sufficiently shorter than the connecting rod portion 8 of each main spring 3. In other words, the length of the connecting rod portion 10*a* of each intermediate support spring 4 is predetermined to be substantially equal to that of a diagonal line of each rectangle formed by the matrix of connecting rod portions 8. As shown in FIG. 5, in the intermediate support spring 4, the straight portion 11 is connected between each end of the connecting rod portion 10*a* and one end of a corresponding one of the pair of coil spring portions 10. One of the two straight portions 11 is connected to the corresponding end of the connecting rod portion 10*a* through the bent portion 12 which is arranged at a right angle to the straight portion 11. The connecting rod portion 10*a* of each intermediate support spring 4 thus substantially corresponds to a diagonal line of each of the above-mentioned rectangles formed by the matrix of connecting rod portions 8 of the main springs 3. An arcuated portion of one end of the coil spring portions 10 and one of the straight portions 11 integrally formed therewith, is coupled to the connecting rod portions 8 of coresponding main springs 3 by clips 13. In other words, the straight portion 11 and the bent portion 12 integrally formed therwith are brought into tight contact with corresponding connecting rod portions 8 and are coupled therewith by clips 13. Furthermore, as shown in FIG. 7, the other end of each coil spring portion 10 is fastened by staples 20 to one of the plurality of crosspieces 1*b* of the base plate 1.

A steel wire having a circular sectional profile forms the rectangular frame 6 which has substantially the same size as the base plate 1. The frame 6 is fastened by clips 14 to the straight portion 9 of each of the coil spring portions 7 at the periphery of the base plate 1. In other words, the straight portions 9 and the frame 6 are brought into tight contact with each other and are fixed by the clips 14. Furthermore, each corner spring 5 comprises a coil spring portion 15 and a linear connecting rod portion 16 formed integrally with one end of the coil spring portion 15. The terminal end of the connecting rod portion 16 is bent at a predetermined angle so as to form a bent portion 17. One end of the coil spring portion 15 of the corner spring 5 is fastened by clips 19 to a corresponding corner of the frame 6. The other end of the coil spring 15 of the corner spring 5 is fastened by staples 20 to the frame 1*a* as shown in FIG. 7. The bent portion 17 is fastened by a clip 18 to the connecting rod portion 8 of the corresponding main spring 3.

Figure 6:
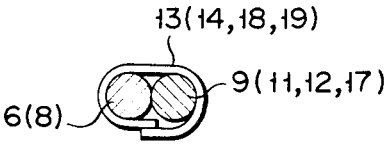
FIG. 6 is an enlarged sectional view showing the state of connection by any one of several clips of a pair of wire rods.

Note that each of the clips 13, 14, 18 and 19 is made of a metal strip of a predetermined width, as shown in FIG. 6. Each clip is bent around a pair of steel wires so as to fasten the pair of steel wires.

In the spring unit having the above-mentioned structure, both ends of the connecting rod portion 8 of each main spring 3 and those of the connecting rod portion 10*a* of each intermediate support spring 4 are integrally formed with the coil spring portions 7 and 10, respectively. The deformation in each of the coil spring portions 7 and 10 due to a compressive load is greater than that in each torsion bar spring. However, even if the compressive load is repeatedly applied to the coil spring portions 7 and 10, there is no tendency for a permanent set to occur. Therefore, the spring unit will not lose its high elasticity at an early stage of use, unlike the conventional spring unit.

The frame 6 is fastened by the clip 14 to each straight portion 9 formed at one end of the coil spring portions 7 of each main spring 3 such that the linear portions thereof are in contact with each other. As a result, the contact length between each coil spring portion 7 and the frame 6 is greatly increased compared with the case where coil spring portions 7 do not have straight portions 9. Accordingly, the coil spring portions 7 and the frame 6 will not become loose at an early stage of use since they are firmly fastened by the clips 14. The coil spring portions 7 of the main springs 3 are properly reinforced by the frame 6 over a long period of time. Furthermore, since the frame 6 and the coil spring portions 7 do not strike each other, no mechanical noise occurs.

Each straight portion 11 of each intermediate support spring 4 is fastened by a clip 13 to the corresponding connecting rod portion 8 of a main spring 3 such that the linear portions thereof contact each other. Each intermediate support spring 4 is firmly fastened to the connecting rod portions 8 of the corresponding main springs 3, thus ensuring the reinforcement of the connecting rod portions 8 of the main springs 3.

Furthermore, the bent portion 17 integrally formed with the connecting rod portion 16 of each corner spring 5 is brought into tight contact with the connecting rod portion 8 of the corresponding main spring 3 and is firmly fastened thereto by a clip 18. As a result, the bent portion 17 and the connecting rod portion 16 are firmly fastened to each other.

What is claimed is:

1. A spring unit, comprising:

a base plate including a first rectangular frame and parallel cross pieces, said frame having a periphery;

a second rectangular frame disposed parallel to the base plate;

a plurality of main springs, each having a first linear connecting rod portion, two first cylindrical spiral coil spring portions interconnected by said linear portion, and first straight portions substantially perpendicular to said linear portion and formed between said linear portion and each spiral coil spring portion, all integrally formed from a single length of wire, such that one end of each of said two first cylindrical spiral coil spring portions is connected to a corresponding one of two ends of said first linear connecting rod portion with a corresponding straight portion interposed perpendicularly therebetween, said plurality of main springs being disposed on the periphery of said first rectangular frame such that a first plurality of said first linear connecting rod portions are substantially at right angles to a second plurality of said first linear connecting rod portions and thereby form a matrix;

first fastening means fastening the other end of each of said first cylindrical spiral coil spring portions to the periphery of said first rectangular frame;

first clip means tightly fixing said second rectangular frame to the first straight portion at said one end of each of said first coil spring portions;

a plurality of intermediate support springs, each having a second linear connecting rod portion, two second spring portions, and second straight portions formed between said second linear portion and each second spring portion such that one end of each of said two second spring portions is connected to a corresponding one of two ends of said second linear connecting rod portion with a corresponding second straight portion interposed therebetween, each of said second linear connecting rod portions being shorter than each of said first linear connecting rod portions, and said plurality of intermediate support springs being disposed on said cross pieces of said first rectangular frame so that the two second spring portions of each intermediate spring are at diagonally opposite corners of intersections of said matrix;

second clip means tightly fixing the second straight portions at one end of each of said second spring portions to intersecting ones of said first linear connecting rod portions at said intersections of said matrix;

second fastening means fastening the other end of each of said second spring portions to said cross pieces of said first rectangular frame;

a plurality of corner springs, each corner spring being integrally formed from a single length of wire and being arranged between respective corners of said first and said second rectangular frames, each of said corner springs comprising a third spring portion having two ends, and a third linear connecting rod portion formed integrally with one end of said third spring portion, said third linear connecting rod portion having a free end bent at a given angle relative to the remainder of said third linear connecting rod portion to form a third straight portion extending integrally from said third linear connecting rod portion;

third fastening means fastening the other end of each of said third spring portions to a corresponding corner of said first rectangular frame;

fourth fastening means fastening each of said third spring portions to a corresponding corner of said second rectangular frame in the vicinity of said one end of each of said third spring portions; and third clip means tightly fixing said third straight portion of each said corner spring to a first linear connecting rod portion of an associated main spring such that said third connecting rod portion extends at a given angle relative to said first linear connecting rod portion to which it is fixed.

2. The spring unit according to claim 1, wherein said second spring portions of said plurality of intermediate support springs comprise coil springs, respectively.

3. The spring unit according to claim 2, wherein said third spring portions of said plurality of corner springs comprise coil springs, respectively.

4. The spring unit according to claim 1, wherein said two first coil spring portions have axes which are parallel to each other.

5. The spring unit according to claim 1, wherein said third spring portions of said plurality of corner springs comprise coil springs, respectively.

* * * * *